United States Patent [19]

Hamburg

[11] Patent Number: 4,789,939

[45] Date of Patent: Dec. 6, 1988

[54] ADAPTIVE AIR FUEL CONTROL USING HYDROCARBON VARIABILITY FEEDBACK

[75] Inventor: Douglas R. Hamburg, Birmingham, Mich.

[73] Assignee: Ford Motor Company, Dearborn, Mich.

[21] Appl. No.: 926,755

[22] Filed: Nov. 4, 1986

[51] Int. Cl.[4] ..... F02M 25/06

[52] U.S. Cl. ..... 364/431.05; 364/431.06; 123/440; 123/489; 73/118.2

[58] Field of Search ..... 364/431.06, 431.05; 123/480, 478, 571, 489, 440, 443; 73/118.2

[56] References Cited

U.S. PATENT DOCUMENTS

| | | | |
|---|---|---|---|
| 3,815,561 | 6/1974 | Seitz | 123/440 |
| 3,831,564 | 8/1974 | Schmidt et al. | 123/440 |
| 3,872,846 | 3/1975 | Taplin et al. | 123/568 |
| 3,939,654 | 2/1976 | Creps | 123/440 |
| 3,969,614 | 7/1976 | Moyer et al. | 364/431.09 |
| 4,029,061 | 6/1977 | Asano | 123/440 |
| 4,142,493 | 3/1979 | Schiva et al. | 364/431.06 |
| 4,258,684 | 3/1981 | Schiva | 123/416 |
| 4,386,592 | 6/1983 | Ohgami et al. | 123/440 |
| 4,554,634 | 11/1985 | Shinoda | 123/480 |
| 4,640,257 | 2/1987 | Kodama et al. | 364/431.06 |

OTHER PUBLICATIONS

"Applying Electronics to Automobile," by George Flynn, Product Engineering, Sep., 1978.

*Primary Examiner*—Parshotam S. Lall
*Assistant Examiner*—Ellis B. Ramirez
*Attorney, Agent, or Firm*—Allan J. Lippa; Peter Abolins

[57] ABSTRACT

An apparatus for controlling operation of an internal combustion engine at lean air fuel ratios includes a fuel controller for generating a fuel injector drive signal. The apparatus also includes a memory table means, a hydrocarbon sensor means, an airflow indication means, and a compensation means. Memory table means stores a schedule of fuel air ratio commands as a function of engine operating conditions. The hydrocarbon sensor means is coupled to the engine for measuring variations in the engine exhaust hydrocarbon emissions and generating an output signal as a function of such variations in hydrocarbon emissions. The airflow indication means generates a signal indicative of airflow into the engine. The compensation means is coupled to the hydrocarbon sensor, the memory table means, and the airflow indicator means for modifying the fuel air ratio control commands stored in the memory table means as a function of airflow and engine exhaust hydrocarbon variation. The compensation means is also coupled to the fuel controller means for applying a fuel command signal to the fuel controller means, thereby permitting engine operation at the lean air fuel ratio limit.

2 Claims, 1 Drawing Sheet

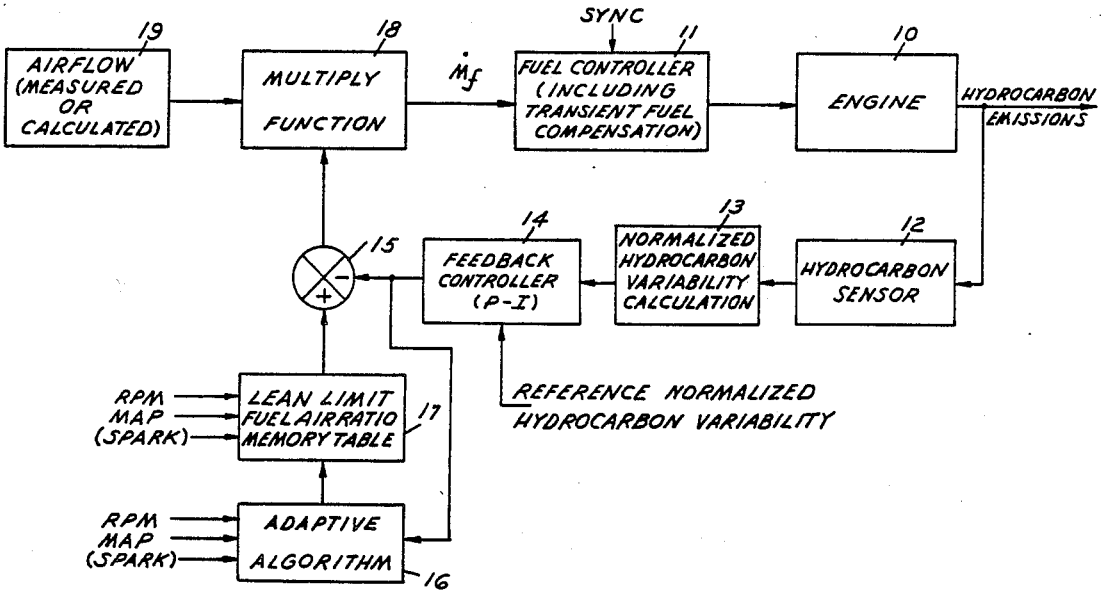

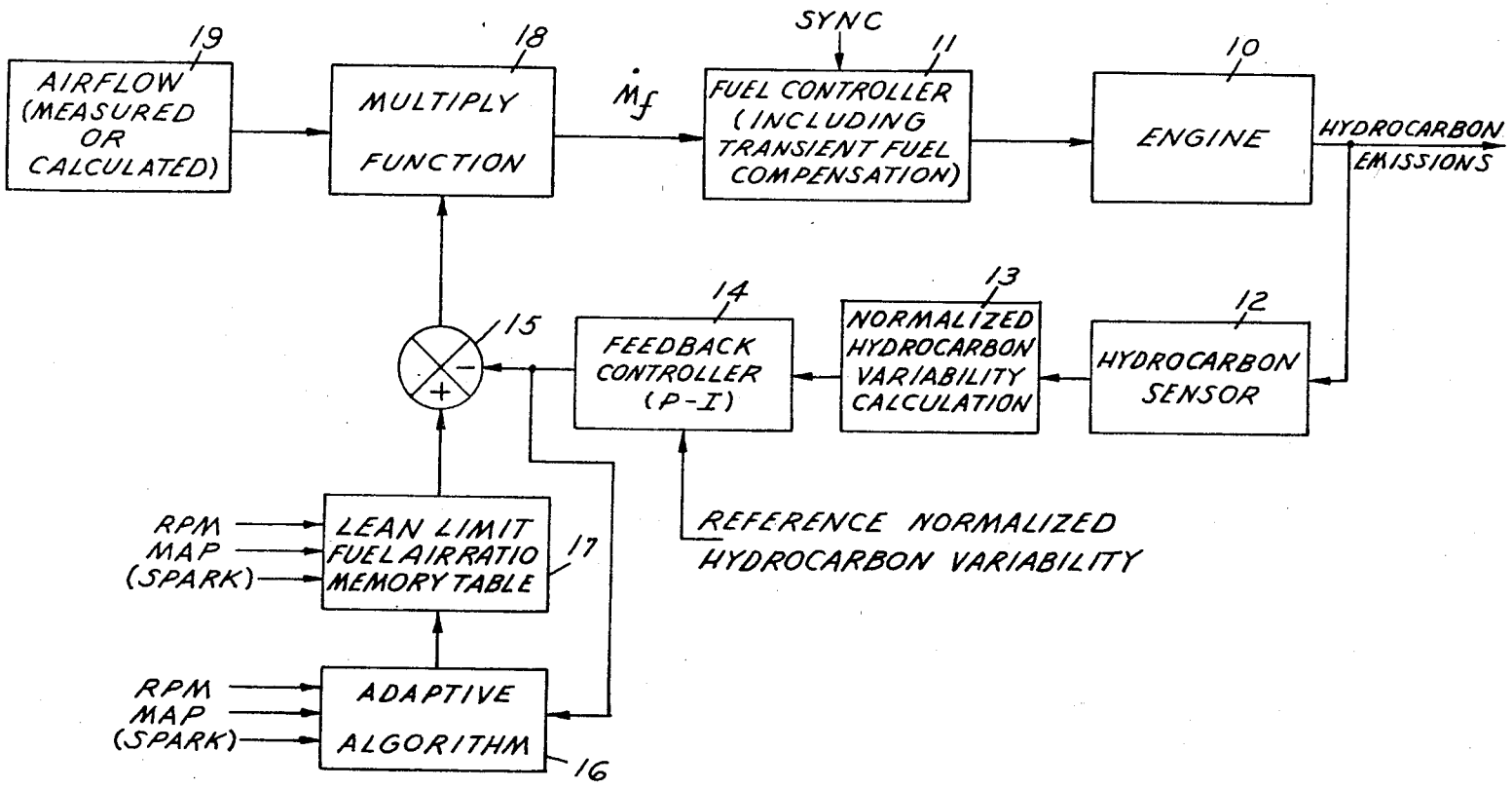
HYDROCARBON EMISSIONS
10
ENGINE
12
HYDROCARBON SENSOR
13
NORMALIZED HYDROCARBON VARIABILITY CALCULATION
SYNC
11
FUEL CONTROLLER (INCLUDING TRANSIENT FUEL COMPENSATION)
14
FEEDBACK CONTROLLER (P-I)
REFERENCE NORMALIZED HYDROCARBON VARIABILITY
$\dot{M}_f$
18
MULTIPLY FUNCTION
15
17
LEAN LIMIT FUEL AIR RATIO MEMORY TABLE
16
ADAPTIVE ALGORITHM
19
AIRFLOW (MEASURED OR CALCULATED)
RPM
MAP
(SPARK)
RPM
MAP
(SPARK)

ADAPTIVE AIR FUEL CONTROL USING HYDROCARBON VARIABILITY FEEDBACK

BACKGROUND OF THE INVENTION

1. Field of the Invention

This invention relates to electronic engine control.

2. Prior Art

Various means for controlling engines electronically are known. For example, U.S. Pat. No. 3,969,614 issued to Moyer et al teaches a method and apparatus for engine control. Adjustments to controlling the energy conversion function of an engine are obtained by sensing at least one engine operating condition, developing an electrical signal indicative of such condition, and, with a digital computer, calculating repetitively values corresponding to settings of the means used to control the energy conversion function of the engine. The digital computer is programmed to calculate these values or settings arithmetically from an algebraic function or functions describing a desired relationship between settings of the energy conversion control means and the sensed condition.

Typical control variables include the throttle angle, fuel flow per cycle, fuel injection timing, ignition timing, and, if EGR is used, the amount of exhaust gases recirculated through the engine. To effect control of these variables that determine the characteristics of the energy conversion process, various engine conditions may be sensed while the engine is operative. Thus, one or more of the following variable engine conditions may be sensed: crankshaft position, engine speed, mass airflow into the engine, intake manifold pressure, throttle angle, EGR valve position, throttle angle rate of change, engine speed rate of change, fuel temperature, fuel pressure, EGR valve rate of change, vehicle speed and acceleration, engine coolant temperature, engine torque, air to fuel ratio, exhaust emissions, etc.

It has been found that there are conditions when it is advantageous to operate with a very lean air fuel ratio. For example, such operation may produce better fuel economy or reduce exhaust emissions. Known engine control systems have difficulty operating the engine at or near the limit of lean air fuel ratios. It would be desirable to find an engine control system that easily and reliably is able to control engine operation at lean air fuel ratios. These are some of the problems this invention overcomes.

SUMMARY OF THE INVENTION

In accordance with an embodiment of this invention, a feedback signal indicative of hydrocarbon variability is used in combination with an engine control system to maintain an engine's air fuel ratio at the lean limit.

An apparatus for controlling the operation of an internal combustion engine at lean air fuel ratios includes a fuel controller means, a memory table means, a hydrocarbon sensor means, an airflow indication means, and a compensation means. The fuel controller means generates a fuel injector drive signal. The memory table means stores a schedule of fuel air ratio control command signals as a function of engine operating conditions. The hydrocarbon sensor means is coupled to the engine and generates an output signal which is a function of the instantaneous hydrocarbon emissions in the engine exhaust. The airflow indication means generates a signal indicative of airflow into the engine. The compensation means is coupled to the hydrocarbon sensor, the memory table means and the airflow indication means for modifying the fuel air command signal stored in the memory table means as a function of airflow and engine exhaust hydrocarbon variation. The compensation means is also coupled to the fuel controller means for applying the fuel command signal to the fuel controller means, thereby permitting engine operation at the lean air fuel ratio limit.

A method in accordance with an embodiment of this invention includes the steps of generating a signal indicative of the engine airflow, determining a fuel air ratio command for the existing engine operating conditions from a memory table, multiplying the airflow signal and the fuel air ratio command together to form a fuel injector control signal, applying the fuel injector control signal to the fuel injectors of the engine, generating a feedback signal as a function of the variation in engine exhaust hydrocarbon emissions, and modifying the fuel air ratio command and the memory table as a function of the hydrocarbon variability feedback signal.

Engine operation in accordance with an embodiment of this invention can maintain an engine's air fuel ratio at the lean limit based on continuously measured variations in the engine's exhaust hydrocarbon emissions. The invention provides good transient air fuel ratio response because of the pre-programming of the fuel air ratio command memory table at the lean limit. The invention provides accurate lean limit operation because of the updating or adapting of the memory table. As described, this invention takes advantage of the fact that hydrocarbon variability increases as the air fuel ratio approaches the lean limit, but before misfire actually occurs.

BRIEF DESCRIPTION OF THE DRAWINGS

The FIGURE is a block diagram of an engine control system in accordance with an embodiment of this invention.

DETAILED DESCRIPTION OF THE INVENTION

Referring to the drawing, an engine 10 is coupled to a fuel controller 11 for receiving a signal to the fuel injectors of the engine and controlling fuel injection. A hydrocarbon sensor 12 is coupled to the exhaust of engine 10 to generate a signal indicative of the instantaneous engine exhaust hydrocarbon emission levels. The output of hydrocarbon sensor 12 is applied to a normalized hydrocarbon variability calculation apparatus 13. The output of normalized hydrocarbon variability calculation apparatus 13 is applied to a feedback controller 14 which in turn has an output applied to a summer 15 and to an adaptive algorithm calculator 16. A reference normalized hydrocarbon variability is also applied to feedback controller 14. The output from adaptive algorithm calculator 16 is applied to summer 15 through a lean limit fuel air limit fuel air ratio memory table 17. Both adaptive algorithm calculator 16 and lean limit fuel air ratio memory table 17 have additional input signals indicative of engine RPM, manifold absolute pressure and, if desired, ignition spark timing. A multiplying function 18 has an input from an airflow indication means 19 and an input from summer 15. The output of multiplication function apparatus 18 is applied to fuel controller 11.

In operation, hydrocarbon sensor 12 generates an output which is a measure of the instantaneous value of the hydrocarbon emissions in the engine exhaust. The normalized variability of the sensor output is obtained in normalized hydrocarbon variability calculation apparatus 13 by continuously computing the current variability of the measured instantaneous hydrocarbon emissions and dividing the result by the corresponding computed average value. The resulting normalized hydrocarbon variability signal is compared with a reference normalized hydrocarbon variability value in feedback controller 14, and the resulting feedback signal is used to trim a lean limit fuel air ratio command supplied by lean limit fuel air ratio memory table 17. The command which is then supplied by fuel controller 11 to engine 10. Further, the hydrocarbon variability feedback signal is used to update or adapt the lean limit fuel air ratio memory table 17 which provides the basic fuel air ratio command to the fuel air control system of engine 10.

More specifically, fuel air ratio memory table 17 containing the basic fuel air ratio command is programmed as a function of engine RPM and engine manifold absolute pressure and, if desired, ignition spark timing, to produce lean limit air fuel ratio conditions for all engine RPM and engine manifold absolute pressure operating points which are expected to occur during engine operation in any driving cycle. At any instant in time, the lean limit fuel air ratio command corresponding to the RPM and MAP at that time will be extracted from fuel air ratio memory table 17 and trimmed by a feedback signal derived from the difference between the normalized hydrocarbon variability signal from hydrocarbon sensor12 and a reference normalized hydrocarbon signal. The corrected fuel air ratio command will then be multiplied by multiplier function apparatus 18 in accordance with an airflow indication signal from means 19. The airflow indication signal from means 19 can either be measured with an airflow meter or calculated using a conventional speed-density algorithm. The output of the multiplier function apparatus 18 is an actual fuel command ($\dot{M}_f$). The fuel command is then applied to fuel controller 11, advantageously with transient fuel compensation for improved dynamic time response, to generate pulse width fuel modulated fuel injector drive signals which will produce lean limit operation.

In order to insure that the engine is actually operating at the lean limit, hydrocarbon emissions in the engine's exhaust are sampled with sensor 12. The normalized variability of the hydrocarbon signal is continuously calculated using normalized hydrocarbon variability calculation apparatus 13, typically an onboard engine control computer. The normalized hydrocarbon variability signal is compared with a reference normalized hydrocarbon variability signal, and the difference is applied to feedback controller 14, advantageously utilizing a proportional plus integral control algorithm for fast response time and minimal steady state error. The resulting feedback signal is used to trim the fuel air ratio command from lean limit fuel air ratio memory table 17 as previously stated.

Additionally, the normalized hydrocarbon variability feedback can be used to update, i.e. adapt, the fuel air ratio memory table 17 using an adaptive algorithm apparatus 16. In accordance with such adapting or updating, any permanent steady state offset errors between the lean limit values stored in fuel air ratio memory table 17 and the lean limit inferred from the hydrocarbon variability measurements made by hydrocarbon sensor 12 can generally be reduced or eliminated. This adapting process is accomplished by using an output of the hydrocarbon variability feedback controller 14 to change the fuel air ratio values stored in fuel air ratio memory table 17 as functions of combinations corresponding to the particular operating conditions where an error may be observed. Adapting of fuel air ratio memory table 17 will only be executed when the engine is operating at any particular combination of RPM and MAP conditions for a sufficiently long period, advantageously several seconds, so that dynamic effects are not significant.

Various modifications and variations will no doubt occur to those skilled in the art to which this invention pertains. For example, the particular function stored in fuel air ratio memory table 17 may be varied from that disclosed herein. One variation would be to store maximum allowable EGR values (i.e., values above which combustion instability occurs) in memory table 17, and use the hydrocarbon variability feedback to dynamically control engine operation at ehe EGR tolerance limit (rather than at the lean air fuel ratio limit) for all operating points. If this is done, the output of memory table 17 is coupled to an EGR controller instead of a fuel controller, with such coupling being de-activated in operating regions where $NO_x$ control is not required and where driveability might be adversely affected. These and all other variations which basically rely on the teachings through which this disclosure has advanced the art are properly considered within the scope of this invention.

I claim:

1. A method for controlling engine operation at a lean fuel air ratio including the steps of:

applying a fuel injector control signal to fuel injectors of the engine as a function of a stored schedule of fuel air ratio command signals;

observing the normalized variability in engine hydrocarbon emissions;

establishing a reference normalized hydrocarbon variabililty;

generating a feedback signal as a function of the difference betweem the observed normalized variability in engine hydrocarbon emissions and a reference normalized hydrocarbon variability;

generating a signal indicative of the airflow into the engine; and modifying the fuel injector control signal as a function of the feedback signal and the airflow signal.

2. A method for controlling engine operation as recited in claim 1 wherein said step of modifying the fuel injector control signal includes the steps of:

comparing the observed exhaust normalized hydrocarbon variation to a reference normalized hydrocarbon variability;

generating a fuel air ratio feedback signal as a function of the difference between the observed and reference normalized hydrocarbon variabilities;

adapting the stored schedule of fuel air ratio as a function of the fuel air ratio feedback signal to account for slowly changing engine characteristics;

forming an updated lean limit fuel air ratio command as a function of a fuel air ratio value indicated by the feedback signal and a fuel air value indicated by the stored schedule of fuel air ratio command signals;

generating a signal indicative of the airflow into the engine;

deriving a lean limit fuel command by multiplying the updated lean limit fuel air ratio command by the airflow signal; and generating a pulse width modulated fuel injector drive signal whose duty cycle is proportional to the updated lean limit fuel air ratio command.

* * * * *